US005924185A

United States Patent [19]

Lallement

[11] Patent Number: 5,924,185

[45] **Date of Patent: *Jul. 20, 1999**

[54] DEVICE AND METHOD FOR REDUCING THE EFFECTIVE CUTTING SURFACE OF A CUTTING MACHINE

[75] Inventor: Régis Lallement, Cestas, France

[73] Assignee: Lectra Systemes, France

[ * ] Notice: This patent is subject to a terminal disclaimer.

[21] Appl. No.: 08/938,458

[22] Filed: Sep. 29, 1997

Related U.S. Application Data

[63] Continuation-in-part of application No. 08/392,893, Apr. 20, 1995, Pat. No. 5,709,023.

[51] Int. Cl.[6] ..... B26D 7/01

[52] U.S. Cl. ..... 29/559; 83/29; 83/451; 83/941; 269/21

[58] Field of Search ..... 83/56, 76.1, 76.6, 83/76.7, 76.9, 451, 940, 941, 19, 22, 29, 422; 269/21; 29/559

[56] References Cited

U.S. PATENT DOCUMENTS

| | | | |
|---|---|---|---|
| 3,598,006 | 8/1971 | Gerber et al. | 83/941 X |
| 3,742,802 | 7/1973 | Maerz | 83/451 |
| 3,815,221 | 6/1974 | Pearl | 83/941 X |
| 4,205,835 | 6/1980 | Gerber | 83/451 X |
| 4,434,691 | 3/1984 | LeBlond | 83/451 X |
| 4,452,113 | 6/1984 | Pearl | 83/941 X |
| 5,289,748 | 3/1994 | Kuchta et al. | 83/941 X |

FOREIGN PATENT DOCUMENTS

| | | |
|---|---|---|
| 2033514 | 12/1970 | France . |
| 2583332 | 12/1986 | France . |

*Primary Examiner*—Eugenia A. Jones
*Attorney, Agent, or Firm*—Jones & Askew, LLP

[57] ABSTRACT

The invention provides apparatus for reducing the working area for cutting on a cutting machine for cutting a stack (1) of sheet material, the machine being provided with an automatic moving cutting tool (4) and with suction apparatus for holding the stack covered in air-impervious film (5) down on a cutting table (3) having a conveyorized support surface 3*a*. The apparatus comprises the air-impervious film (5) for covering the stack (1), an air-impervious movable mask loop (6) designed to cover a portion of the table (3), and a low friction block (65) for positioning the mask (6) over the portion of the table. The mask (6) covers the portion of the table and holds down the film (5) and the mask (6) when suction is applied beneath the table. The mask (6) is able to move across the portion of the table when a conveyor (62) transfers the stack (1) by use of the conveyorized support surface 3*a*.

19 Claims, 8 Drawing Sheets

DEVICE AND METHOD FOR REDUCING THE EFFECTIVE CUTTING SURFACE OF A CUTTING MACHINE

RELATED APPLICATIONS

The present application is a continuation-in-part of U.S. patent application Ser. No. 08/392,893 entitled "Device and Method for Reducing the Effective Cutting Surface of a Cutting Machine" filed on Apr. 20, 1995 now U.S. Pat. No. 5,709,023.

TECHNICAL FIELD

The present invention relates to a method and apparatus for reducing the working surface area on the cutting table of an automatic machine for cutting a stack of sheet material.

BACKGROUND OF THE INVENTION

Machines for automatic cutting of sheet material (cloth, skins, paper, . . . ), generally comprise a working table on which material to be cut is stacked, a film that is impervious to air that covers the stack of material, a suction means that holds the stack of material down on the table by suction, and a moving cutting tool that moves over the stack. For optimization purposes, the working table may itself be constituted by a conveyor that constitutes a support surface and that is also designed to transfer the stack.

It happens that some users of such machines need to cut sheets of width that are smaller than the working width of the cutting machine, or sheets that are of standard width but folded in two. During such cutting, a large portion of the cutting table is not covered in material, however the impervious film must nevertheless cover the entire cutting zone in order to provide the sealing necessary for the stack-holding suction. By proceeding in this way, half of the impervious film is used up needlessly, and that is quite wasteful.

An object of the present invention is to solve these drawbacks in a satisfactory manner.

SUMMARY OF THE PRESENT INVENTION

According to the invention, this object is achieved by means of an apparatus for reducing the working area for cutting on a cutting machine. The cutting machine is used for cutting a stack of sheet material. The cutting machine has a cutting table to support the stack. The cutting table has a surface and a leading edge relative to a displacement direction (F) of the stack by a conveyor which forms the support surface for the stack. The working area is on the conveyorized support surface of the cutting table. As part of the cutting machine, an automatic moving cutting tool is movably coupled to the cutting table and capable of cutting the stack within the working area. The cutting machine also includes a movable suction apparatus beneath the working area for providing suction to the working area.

In general, the apparatus for reducing the working area includes an air-impervious film, an air-impervious mask loop and positioning structure for rotatably positioning the mask loop over a portion of the working area. Thus, the mask loop is advantageously positioned without being fixed to the cutting table.

The air-impervious film covers the stack and holds the stack down on the working area in response to applying suction from the suction apparatus. The air-impervious mask loop covers the portion of the working area without covering the stack and is held down in response to applying suction from the suction apparatus. The positioning means or structure positions the mask loop over the portion of the working area. Typically, the positioning means is a block around which an upstream end of the mask loop rotates. This block is fixed relative to the cutting table. In this way, the portion of the working area is advantageously covered by the mask loop in order to reduce the working area while also reducing wear and tear on the mask loop.

According to an advantageous aspect of the invention, the mask loop has an outer surface. A part of the outer surface is held down in contact with the portion of the working area in response to applying the suction. The part of the outer surface of the mask loop typically moves across the portion of the working area in response to moving the conveyorized support surface within the working area. In other words, the mask loop can rotate around the block in response to moving the conveyorized support surface.

Additionally, the present invention may include a guide, which is fixed relative to the cutting table. The guide advantageously prevents a downstream end of the mask loop from drifting off of the portion of the working area.

The invention also provides a method for reducing a working area for cutting on a cutting machine using a rotatable air-impervious mask. Typically, the mask is a loop of air-impervious material. The method is characterized by positioning the mask over a portion of the working area defined on a surface of a cutting table. The cutting table is part of the cutting machine. By positioning the mask over the portion of the working area without requiring the mask to be fixed relative to the cutting table, wear and tear is advantageously reduced on the mask.

Next, an air-impervious film is placed on a stack of sheet material in a remaining portion of the working area that is not occupied by the mask. The dimensions of the film are close to those of the stack such that the film overlies an edge of the mask. The film is held down on the stack by applying suction from a suction apparatus connected beneath the working area such that the working area is advantageously reduced by the portion of the working area that is covered by the rotatable mask.

Additionally, the method may include the step of causing the mask to move above the portion of the working area, preferably by moving the conveyorized support surface within the working area. When the mask is a loop of air-impervious material, the method may also include the step of causing the loop to rotate around a block fixed to the cutting table by moving the conveyorized support surface within the working area.

Additionally, the method may include preventing the rotatable mask from drifting off the portion of the working area, typically using the guide to accomplish this step. This advantageously allows for a lengthy rotatable mask to be used on the cutting machine.

The method may also include matching the width of the rotatable mask to a desired width of the portion of the working area based upon the width of the stack. In this manner, the invention is able to use differing widths of masks to match the width of the stack and to advantageously minimize or optimize the consumption of the impervious film.

Other characteristics and advantages of the present invention appear more clearly on reading the following description of various embodiments of the invention given as non-limiting examples.

BRIEF DESCRIPTION OF THE DRAWINGS

The description refers to the accompanying drawings, in which.

DETAILED DESCRIPTION

Figure 1:
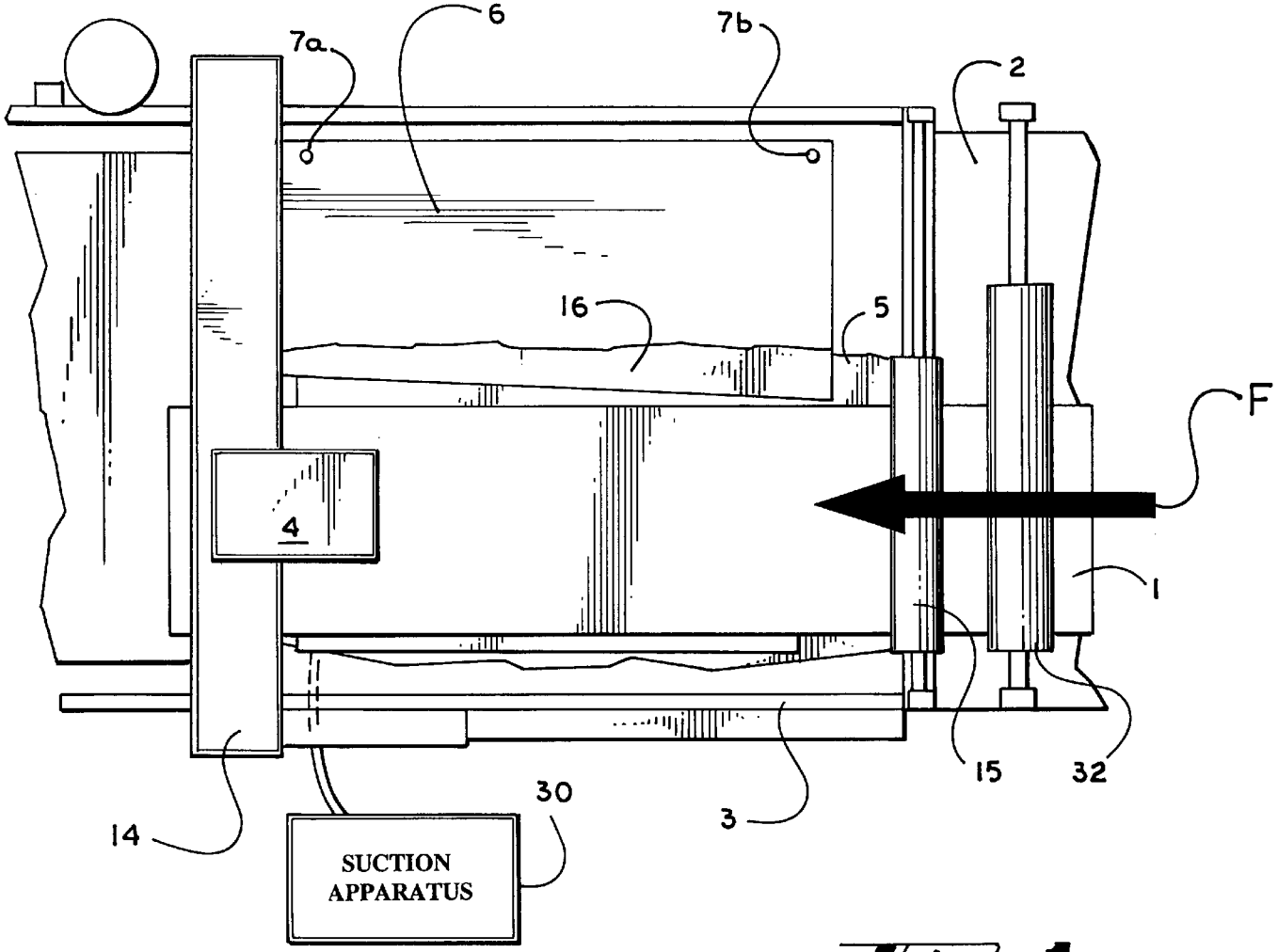
FIG. 1 is a plan view of the apparatus of the invention.

The apparatus for reducing the working cutting area as shown in FIG. 1 is designed to be fitted to a machine for cutting a stack 1 of sheet material. The machine is of the type comprising a spreading table 2 extended by a cutting table 3 optionally fitted with a conveyorized support surface 3*a,* associated with an automatic moving cutting tool 4 carried by a beam 14 that is itself capable of moving, and suction means 30 (not shown) beneath the cutting table 3 for holding down the stack 1 which is covered in a film 5 that is impervious to air and that is paid out from at least one roll 15.

The apparatus of the invention comprises a removable mask 6 that is impervious to air and that is designed to cover a portion of the table 3. As a function of the required working surface area, the mask 6 is held in a determined position by fixing and positioning means. The apparatus of the invention also comprises detection means for detecting the position of the mask 6 and for participating in the control of the cutting tool 4, 14 so as to prevent the mask being cut.

The detection means, such as electrical or pneumatic sensors may be fixed on the table 3 so as to identify the position of the mask 6. The detected information is processed by the numerical control system of the cutting machine which is capable of actuating one or more mechanical abutments that correspond to the boundaries of the new cutting zone defined by installing the mask. These abutments are situated on the moving beam 14 along which the cutting head moves across the width of the working surface. In the event of an accident during cutting, the mechanical abutments serve to prevent the cutting head 4 from proceeding to destroy the impermeable mask 6.

The mask 6 includes a narrow porous strip 16 which extends substantially parallel to the edge marking the boundary between the mask 6 and the working surface of the table 3. In order to obtain the best possible sealing, the impervious film 5 is always wider than the working cutting zone. Thus, it overlies the edge of the mask 6 and the porous strip 16 serves to pass enough air so as to hold down the impervious film 5 by suction. The porous strip 16 serving to hold down the impervious film 5 may be implemented by perforating the mask 6. Another possibility consists in attaching the edge of the mask to a strip of material that is porous and that has the same flexibility as the mask.

In the embodiment shown in FIG. 1, the fixing and positioning means are constituted by at least two eyes 7*a* and 7*b* formed in the outside peripheral edge of the mask 6 so that the eyes 7*a* and 7*b* lie on a line that is substantially parallel to the advance direction F of the stack 1.

The eyes 7*a* and 7*b* cooperate fixing and positioning members (not shown) associated with the table 3 such as pegs or studs.

Under such conditions, various widths and thus various areas of mask 6 can be placed and fixed on the table 3 so as to match the mask to the width of the stack 1 that is to be cut.

Figure 2:
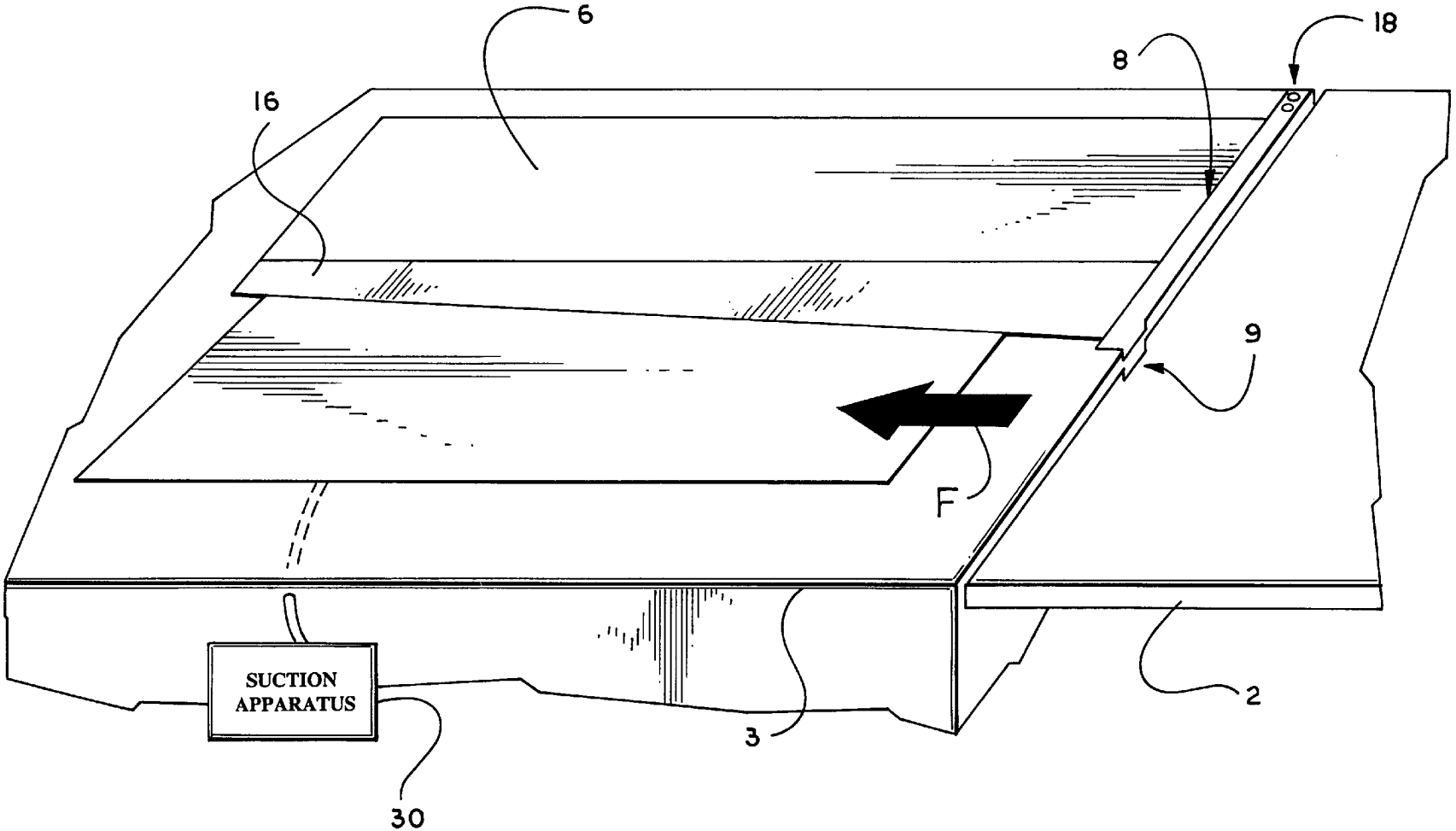
FIG. 2 is a perspective view of an embodiment of the apparatus of the invention.

In the embodiment of the invention shown in FIG. 2, the fixing and positioning means are constituted by an angle strip 8 secured to the end edge of the mask 6, and an abutment 9 serving to retain the strip 8 while a stack 1 is being transferred (FIG. 1). Fixing holes 18 for the strip 8 are formed at the end of the strip opposite to the abutment 9 and they cooperate with fixing members (not shown) associated with the loading edge of the table 3 as defined by the advance direction F of the stack 1. The horizontal length of the angle strip lies on the table 3 while its vertical length forms the abutment 9. The abutment could also be formed by a lug (not shown) formed on the strip at its end opposite from the fixing holes 18. The cutting table 3 of the conveyor generally includes a bed that can be penetrated by the cutting tool (a vibrating blade, . . . ) and made up of slabs whose top faces are covered in bristles. The bristles extend perpendicularly to the stack 1 which they support and they are often of uneven length, thereby defining multiple small points.

Consequently, the air-impermeable mask 6 is made using a flexible material which must withstand the abrasive due to rubbing on the ends of the bristles of the cutting table while the conveyor is in operation. The mask 6 made in this way can be rolled up and stored while the cutting machine is being used at full width. Materials that can be used are of the following types: flexible plastics, mylar, rubber, paper, etc.

The air-impermeable mask 6 must project beyond the outside edges of the working portion of the cutting table or conveyor that it covers in order to establish good sealing and restrict leaks when suction is established.

While the cutting conveyor is advancing, the pointed ends of the bristles could damage the edge of the mask 6 defining the area of the working cutting zone. To avoid that drawback, the edge in question is inclined relative to the displacement direction of the cutting conveyor. This inclination may be defined by the fact that the longer end of the mask 6 perpendicular to the displacement direction F is situated at the end where the stack 1 is placed on the cutting machine. Thus, as the bristles move during stack advances, the ends of the bristles raise the edge of the impermeable mask 6 and cannot damage it.

Figure 3A:
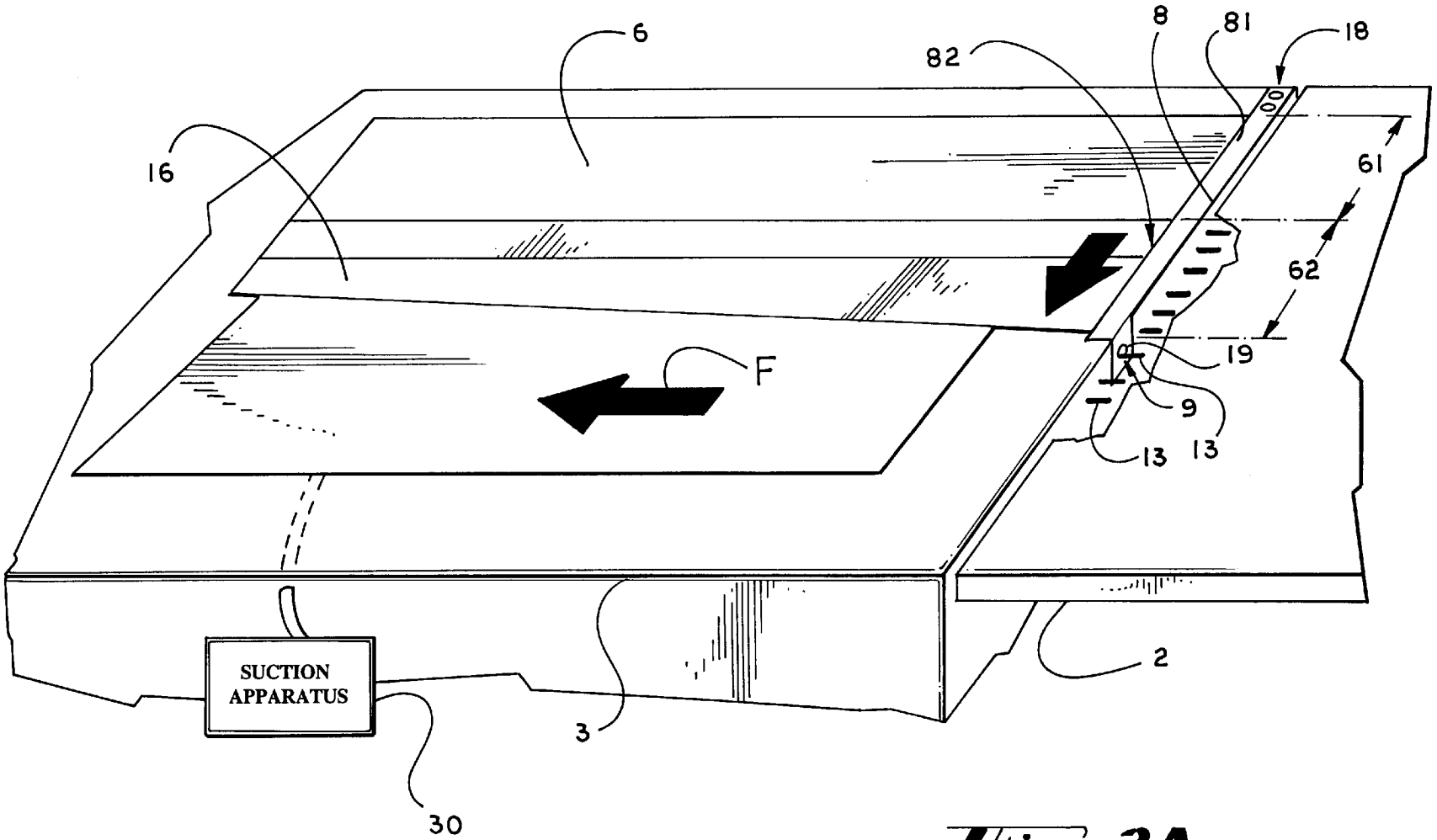
FIGS. 3*a* and 3*b* are perspective views of other embodiments.

In the embodiment of FIG. 3*a,* the strip 8 comprises two portions 81 and 82. A first portion 81 is secured to a first length 61 of the mask 6 and is fixed to the edge of the table 3 by means of holes 18.

A second portion 82 is secured to a second length 62 of the mask 6 that includes the porous strip 16 and is movable in translation relative to the first portion 81, being suitable for being locked in a position such that the first and second lengths 61 and 62 of the mask 6 overlap. The second portion 82 of the strip 8 carries the abutment 9.

By causing the second portion 82 to slide after the first portion 81 has been fixed on the table 3, the operator can adjust the width of the mask to the desired working cutting area. The abutment 9 carried by the second portion 82 of the strip is provided with locking means for locking it in the corresponding position, said means being in the form of eyelets 19. For example, they may be constituted by a single eyelet that the operator fixes to the loading edge of the table 3 which is provided with lugs 13. The operator chooses a lug 13 that corresponds to the desired width and fixes the corresponding eyelet 19 of the abutment 9 thereto.

Figure 3B:
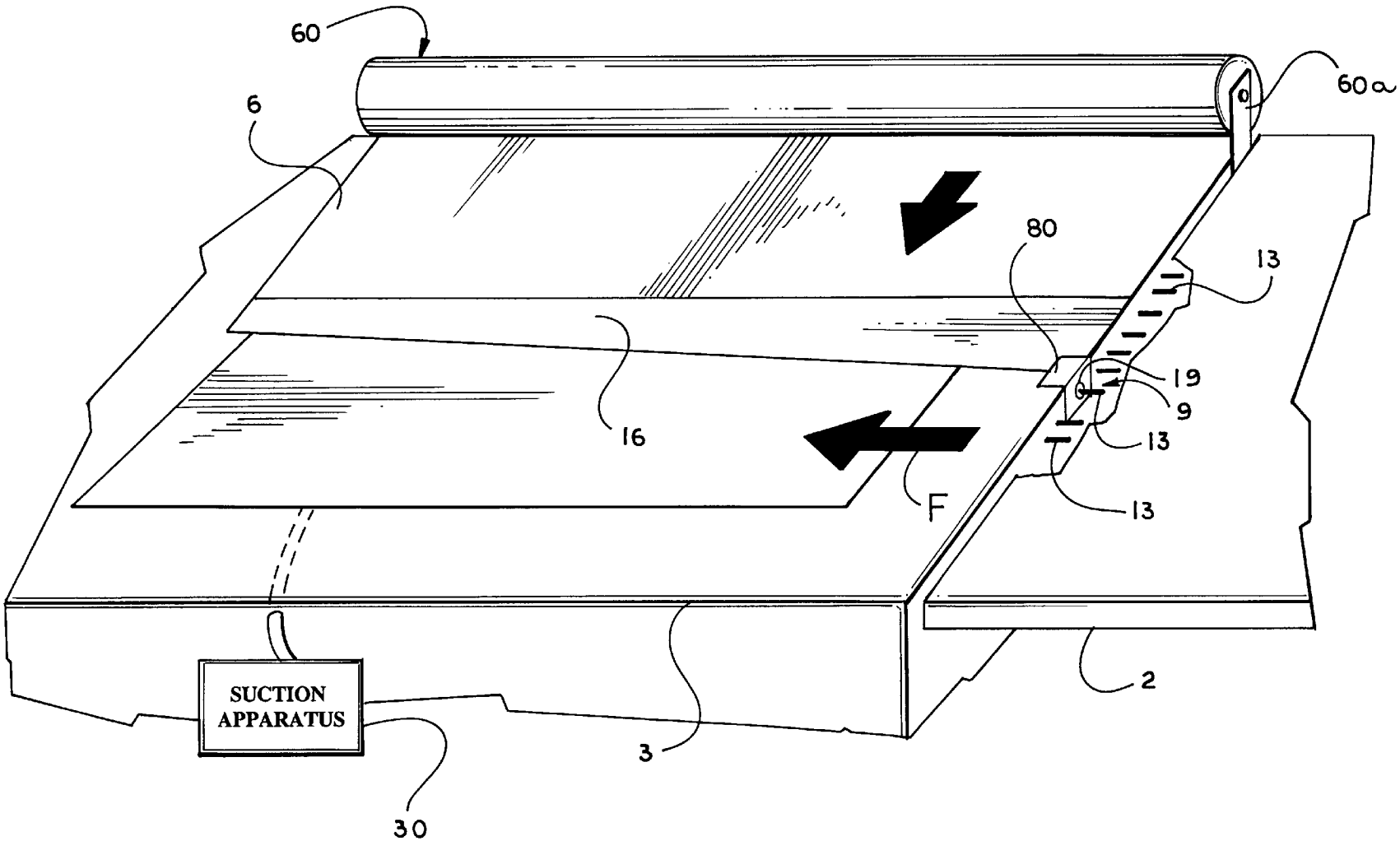

In the embodiment of FIG. 3*b,* the apparatus includes means for feeding a variable width of impervious mask 6.

The mask 6 is then paid out over a determined width of the table 3 from a roll 60 disposed along one side of the table 3 and mounted on a support 60*a* that is secured to said table. The free end of the mask 6 includes the porous strip 16 and it is fixed to the table 3 by means of a strip 80 similar to the second portion 82 of the strip shown in FIG. 3*a*. The strip 80 likewise includes an abutment 9 provided with an eyelet 19 for locking by cooperating with lugs 13 of the table 3.

In yet another embodiment (not shown), the apparatus includes means for feeding different sizes of impermeable film 5, which means are preferably adjacent to and match the means for feeding the stack 1 to be cut. Thus, provision is made for rolls 15 to be of a width close to that of the working cutting area so as to optimize consumption of the impervious film 5.

These feed means are disposed above the loading edge of the cutting table 3 and enable an appropriate width of impervious film to be spread over the stack 1.

While the above-described embodiments of the present invention utilize a fixed mask relative to the cutting table and the displacement direction F, the present invention also contemplates using a mask that can be moved or rotated relative to the displacement direction F of the conveyorized support surface 3*a*. A movable or rotatable mask is useful to avoid abrasions due to friction with bristles within the working area of the cutting table as the conveyorized support surface 3*a* moves the stack. FIGS. 4–7 illustrate another embodiment of the present invention where the air-impervious mask 6 is a movable and rotatable loop, which is not fixed relative to the cutting table and the displacement direction F of the conveyorized support surface 3*a*.

Figure 4:
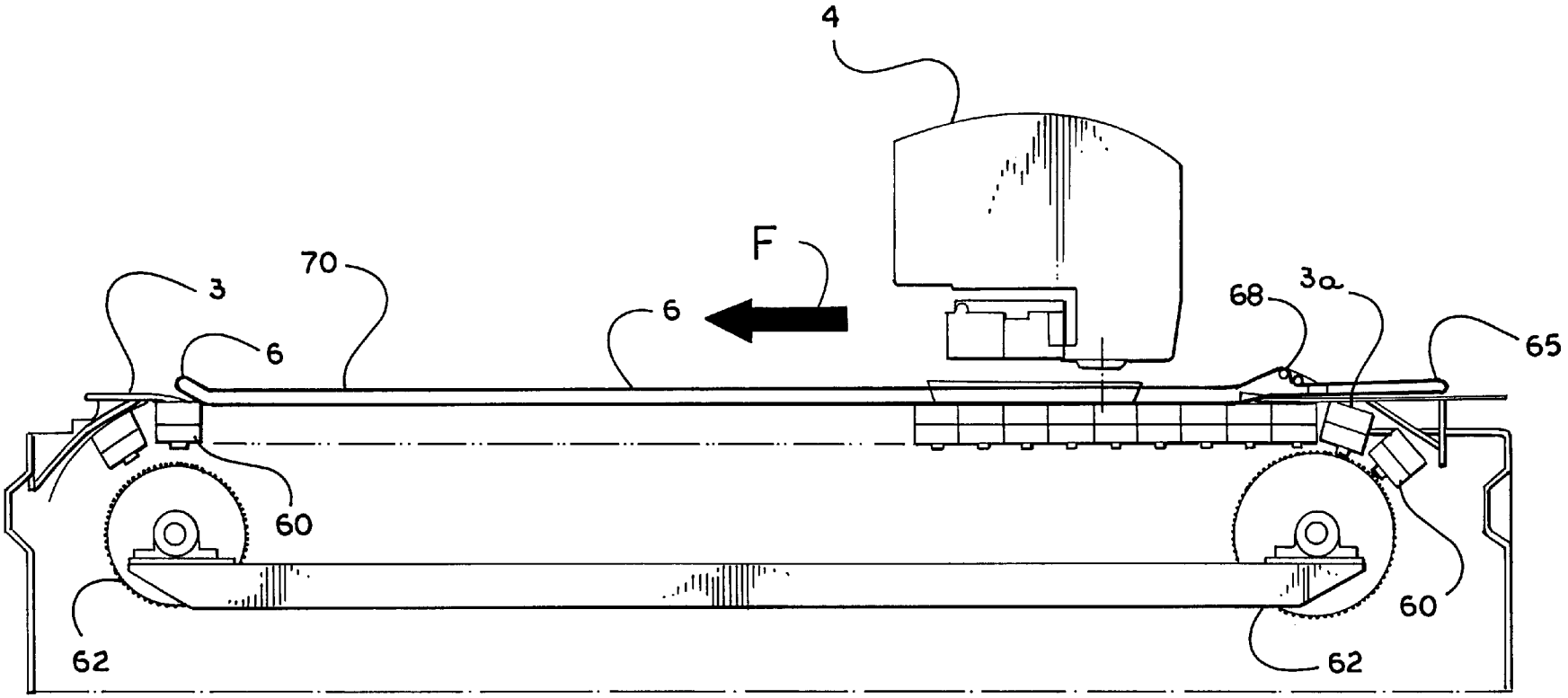
FIG. 4 is a profile view of an embodiment of the present invention using a rotatable mask loop.

Referring now to FIG. 4, the mask 6 is preferably a mask loop of air-impervious material, which can be moved or rotated above the working area of the conveyorized support surface 3*a* in a continuous fashion. In general, as the mask loop 6 moves, a part of an outer surface of the mask loop is positioned within part of the working area. To properly position the mask loop 6, an upstream end of the mask loop 6 rotates around a low friction block 65, which is fixed relative to the cutting table. A set of rollers 68 provides tension on the mask loop 6 as it moves around the low friction block 65 and then over the part of the working area. The upstream end of the mask loop 5 and how it rotates is described in more detail with regard to FIG. 6 below.

This embodiment of the present invention is especially useful in environments where the cutting machine has a conveyorized support surface 3*a* as part of its working area. In such an environment, the cutting machine includes a conveyor system 62 having movable blocks 60 of conventional bristle which form the conveyorized support surface 3*a*. The bristle blocks 60 support and transfer the stack 1. Suction is applied from beneath each block 60 by a conventional suction apparatus 30. In response to applying suction, the mask loop 6 is held down against the bristle blocks within the part of the working area of the cutting table. Therefore, as the conveyorized support surface 3*a* consisting of blocks 60 moves within the working area in the displacement direction F and suction is applied through each moving block 60, the mask loop 6 is caused to move in the displacement direction F along with the moving block 60.

One skilled in the art will recognize that there is no relative motion between the moving block 60 (as actuated by the conveyor 62) and the mask loop 6 when the mask loop 6 moves as described above. By moving the mask loop 6 along with the moving block 60, the mask loop 6 is exposed to less friction and abrasions from the bristles, thus preventing wear on the mask loop 6.

Furthermore, one skilled in the art will realize that a mask loop 6 may be caused to move according to the present invention regardless of whether movement or rotation of the mask loop 6 is directly motorized. The important focus of this embodiment of the present invention is using a movable (non-fixed) mask to reduce the working area of the cutting table.

An optional guide 70 is also provided in this embodiment. The optional guide 70 is used to prevent a downstream end of the mask loop 6 from drifting off the part of the working area desired to be covered. Preventing drifting of the mask loop 6 is especially useful when the mask loop 6 is lengthy. The optional guide 70, like the low friction block 65 and the rollers 68, is fixed relative to the cutting table over part of the working area. In summary, the low friction block 65, the rollers 68, and the optional guide 70 can each be used to position the mask loop 6 over part of the working area when the mask loop 6 rotates or moves relative to the cutting table.

Figure 5:
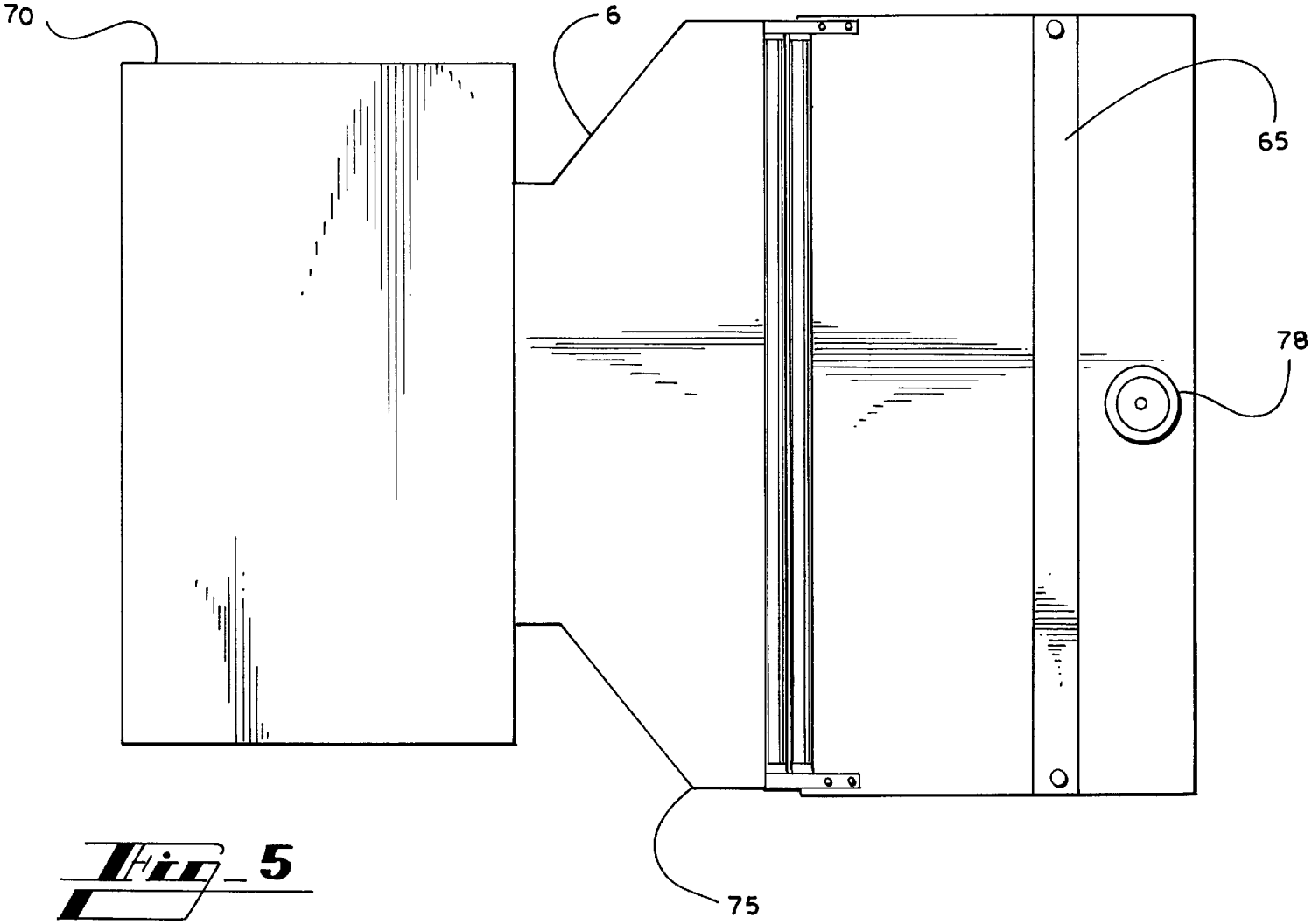
FIG. 5 is a top view of an exemplary mechanical support used in an embodiment of the present invention.

FIG. 5 is an illustration of an exemplary mechanical support for mounting the low friction block 65, the rollers 68, and the optional guide 70. In one embodiment, the optional guide 70 may be connected directly to the cutting table. However, in another embodiment, the optional guide 70, as well as the low friction block 65 and the rollers 68, may be connected to a removable mechanical support 75 separate from the cutting table. The removable mechanical support 75 is preferably a removable rigid structure capable of being attached and fixed to the cutting table via a fixation hole 78. While being fixed to the cutting table, the removable mechanical support allows the mask loop 6 to move and rotate above part of the working area.

The removable mechanical support 75 can be removed and replaced when using mask loops of differing widths. For example, if the stack 1 is too wide, the existing mechanical support 75 is easily removed and another mechanical support matching the desired width of a portion of the working area can be quickly attached and fixed to the cutting table. In other words, the width of the mask loop 6 can be matched to the desired width of the portion of the working area to be covered up based on the width of the stack 1.

At the downstream end of the mask loop 6, the mask loop 6 is freed from suction when the moving blocks 60 are moved out of the working area by the conveyor 62. The mask loop 6 is then free to rotate back towards the rollers 68 and low friction block 65 on the upstream end.

Figure 6:
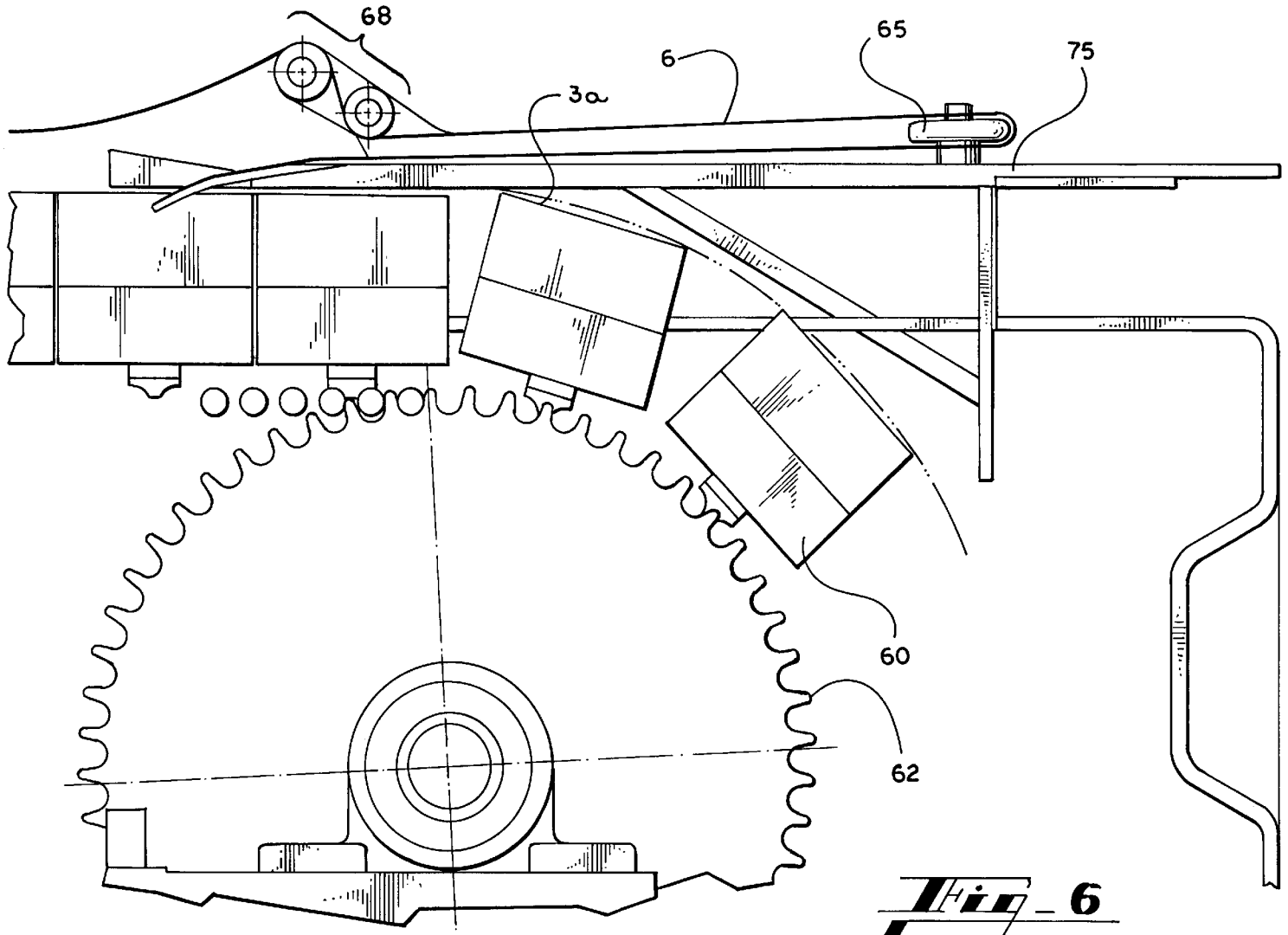
FIG. 6 is a detailed view of an upstream end of an exemplary rotatable mask loop illustrating how the loop is connected to a cutting machine.

FIG. 6 is a detailed view of the upstream end of an exemplary rotatable mask loop illustrating how the loop is connected to a cutting machine. Referring now to FIGS. 4–6, the mask loop 6 is shown as it returns from the downstream end and is threaded through the rollers 68, which are offset to provide tension. The mask loop 6 is then positioned around the low friction block 65. In this configuration, movement of the conveyor 62 causes the movable blocks 60 to move in the displacement direction F. Although not shown, it is understood in the art that each of the movable blocks 60 is provided with suction from the suction apparatus 30. As the movable blocks 60 move into the working area of the cutting table, the suction is applied to part of the outer surface of the mask loop 6. Accordingly, the mask loop 6 is caused to move through the rollers 68, around the low friction block 65, and over part of the working area via the suction applied. In this way, the mask loop 6 continuously moves and rotates over part of the working area while minimizing the friction and abrasive wear on the mask loop 6.

Figure 7:
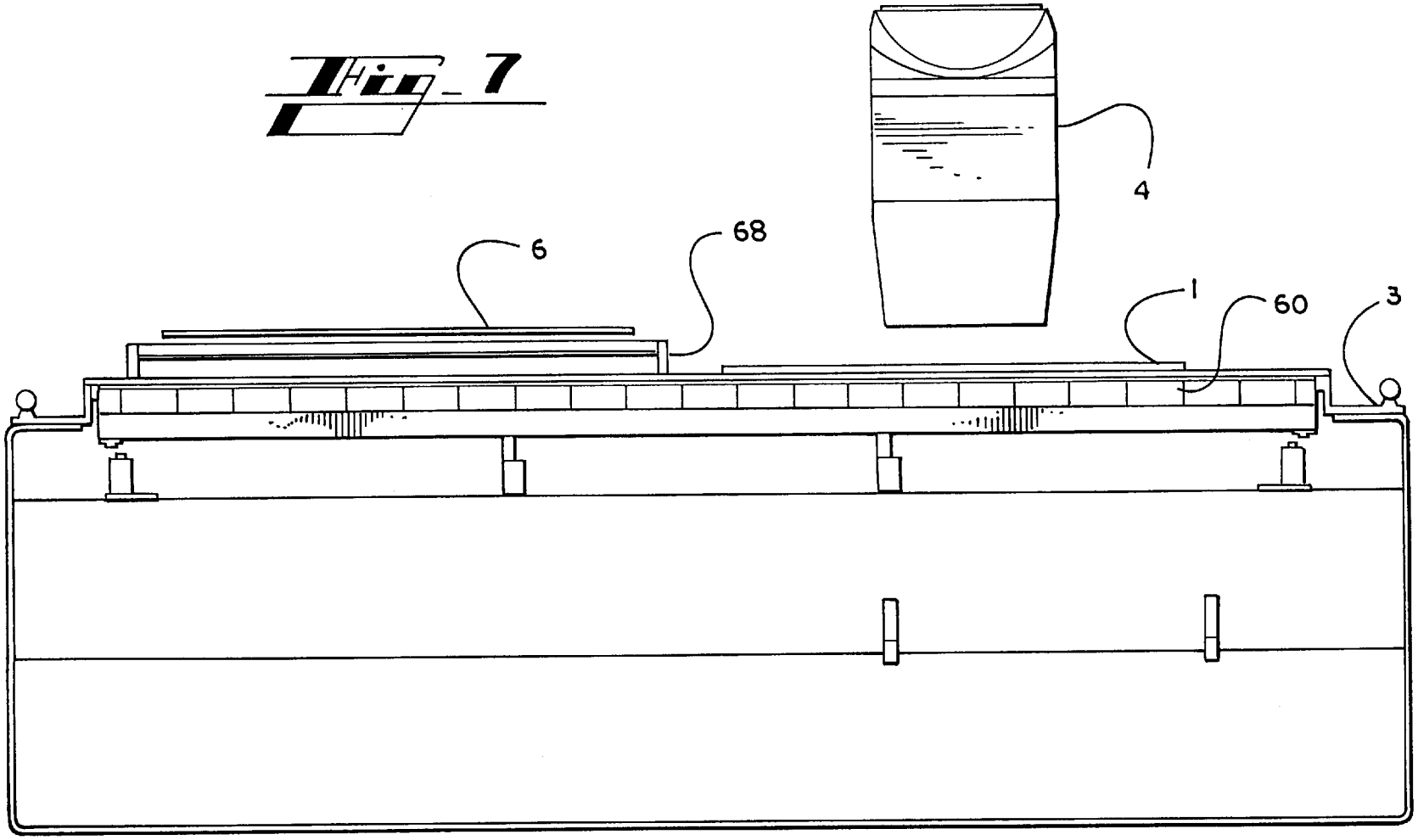
FIG. 7 is a front view of an embodiment of the present invention using a rotatable mask loop.

FIG. 7 is a front sectional view of an embodiment of the present invention using a rotatable mask loop. In the front view, the separation of the cutting head and the part of the working area covered by the mask 6 is illustrated. Referring now to FIGS. 4–7, while covering part of the working area with the mask loop 6, the cutting head 4 can efficiently operate on the stack 1 covered with the film 5 on the other part of the working area. In this manner, the mask 6 covers part of the working area and less film 5 is required to cover the working area in order to properly hold the stack 1 down during cutting operations.

The present invention has been described in relation to particular embodiments which are intended in all respects to be illustrative rather than restrictive. Alternative embodiments will become apparent to those skilled in the art to which the present invention pertains without departing from its spirit and scope. Accordingly, the scope of the present invention is defined by the appended claims rather than the foregoing description.

What is claimed is:

1. A method for reducing a working area for cutting on a cutting machine using a rotatable air-impervious mask, comprising the steps of:

positioning said mask over a portion of the working area defined on a conveyorized support surface of a cutting table, said cutting table being part of said cutting machine;

placing an air-impervious film on a stack of sheet material in a remaining portion of said working area that is not occupied by said mask, the dimensions of said film being close to those of said stack such that said film overlies an edge of said mask; and holding down said film on said stack by applying suction from a suction apparatus connected beneath said working area such that said working area is reduced by said portion of said working area that is covered by said rotatable mask.

2. The method according to claim 1 further comprising the step of causing said mask to move above said portion of said working area.

3. The method according to claim 2, wherein the step of causing said mask to move comprises moving said conveyorized support surface within said working area.

4. The method according to claim 1, wherein said rotatable mask comprises a loop of air-impervious material.

5. The method according to claim 4 further comprising the step of causing said loop to rotate around a block fixed to said cutting table.

6. The method according to claim 5, wherein the step of causing said loop to rotate comprises moving said conveyorized support surface within said working area.

7. The method according to claim 1 further comprising the step of preventing said rotatable mask from drifting off said portion of said working area.

8. The method according to claim 1 further comprising the step of matching the width of said rotatable mask to a desired width of said portion of said working area based upon the width of said stack.

9. In a cutting machine used for cutting a stack of sheet material, said cutting machine comprising a cutting table to support said stack, said cutting table having a conveyorized support surface and a leading edge relative to a displacement direction (F) of said stack, a working area on the conveyorized support surface of said cutting table, said working area having a plurality of outside edges, an automatic moving cutting tool movably coupled to said cutting table and capable of cutting said stack within said working area, and a suction means beneath said working area for providing suction to said working area, an apparatus for reducing said working area for cutting on said cutting machine, comprising:

an air-impervious film that covers said stack and holds said stack down on said working area in response to applying suction from said suction means;

an air-impervious mask loop that covers a portion of said working area without covering said stack, said mask loop being held down on said portion of said working area in response to applying suction from said suction means; and a positioning means for rotatably positioning said mask loop over said portion of said working area in order to cover said portion of said working area and to reduce said working area by said portion of said working area that is covered by said mask.

10. The apparatus according to claim 9, wherein said mask loop has an outer surface, a part of said outer surface is held down in contact with said portion of said working area in response to applying said suction from said suction means.

11. The apparatus according to claim 10, wherein said part of said outer surface of said mask loop moves across said portion of said working area in response to moving said conveyorized support surface.

12. The apparatus according to claim 11, said positioning means comprises a block around which an upstream end of said mask loop rotates, said block being fixed relative to the cutting table.

13. The apparatus according to claim 12, wherein said mask loop is capable of rotating around said block in response to moving said conveyorized support surface.

14. The apparatus according to claim 13, said positioning means further comprises a guide to prevent a downstream end of said mask loop from drifting off of said portion of said working area, said guide being fixed relative to said cutting table.

15. In a cutting machine used for cutting a stack of sheet material, said cutting machine comprising a cutting table to support said stack, said cutting table having a surface and a leading edge relative to a displacement direction (F) of said stack, a working area on the surface of said cutting table, said working area having a plurality of outside edges, an automatic moving cutting tool movably coupled to said cutting table and capable of cutting said stack within said working area, and a suction means beneath said working area for providing suction to said working area, an apparatus for reducing said working area for cutting on said cutting machine, comprising:

an air-impervious film that covers said stack and holds said stack down on said working area in response to applying suction from said suction means;

an air-impervious removable mask that covers a portion of said working area without covering said stack and is held down on said portion of said working area in response to applying suction from said suction means; and a positioning means for holding said mask in a determined position on said cutting table in order to cover said portion of said working area and to reduce said working area by said portion of said working area that is covered by said mask.

16. The apparatus according to claim 15, wherein said mask projects beyond said plurality of outside edges of said portion of said working area covered by said mask.

17. The apparatus according to claim 15, wherein said mask includes a porous strip that extends parallel to a boundary between said mask and said working area.

18. The apparatus according to claim 17, wherein said boundary is inclined relative to the displacement direction in which said stack is transferred across said cutting table.

19. The apparatus according to claim 15, wherein said mask is made of a material that is sufficiently flexible to be rolled up in and paid out from a roll disposed on one side of said cutting table.

* * * * *